US006919381B2

(12) United States Patent
Núñez et al.

(10) Patent No.: US 6,919,381 B2
(45) **Date of Patent: *Jul. 19, 2005**

(54) PROCESS FOR PREPARING SOLUTIONS WITH ADDITIVES AND SURFACTANTS

(75) Inventors: Gustavo A Núñez, Miranda (VE); Clara E Mata, Miranda (VE); Carolina Blanco, Miranda (VE)

(73) Assignee: Intevep, S.A., Caracas (VE)

( * ) Notice: Subject to any disclaimer, the term of this patent is extended or adjusted under 35 U.S.C. 154(b) by 0 days.

This patent is subject to a terminal disclaimer.

(21) Appl. No.: 10/162,090

(22) Filed: Jun. 3, 2002

(65) Prior Publication Data

US 2003/0223307 A1 Dec. 4, 2003

(51) Int. Cl.[7] ..... B01F 3/08

(52) U.S. Cl. ..... 516/53; 516/76; 516/924; 366/336; 366/175.2

(58) Field of Search ..... 516/53, 76, 924, 516/113, 197; 366/175.2, 181.5, 336, 337, 338, 339, 340

(56) References Cited

U.S. PATENT DOCUMENTS 4,402,916 A * 9/1983 Luetzelschwab ..... 366/336
4,674,888 A * 6/1987 Carlson ..... 366/337
4,966,182 A * 10/1990 Lavelle et al. ..... 366/336
4,976,137 A * 12/1990 Decker et al. ..... 324/439
5,000,872 A * 3/1991 Olah ..... 516/76
5,484,203 A * 1/1996 King et al. ..... 366/337
5,503,772 A * 4/1996 Rivas et al. ..... 516/53
5,908,612 A * 6/1999 Dailey et al. ..... 424/49
6,623,155 B1 * 9/2003 Baron ..... 366/181.5
6,677,387 B2 * 1/2004 Gurfinkel Castillo et al. 516/76
2003/0072214 A1 * 4/2003 Fleischli et al. ..... 366/175.2

* cited by examiner

*Primary Examiner*—Daniel S. Metzmaier
(74) *Attorney, Agent, or Firm*—Bachman & LaPointe, P.C.

(57) ABSTRACT

A process for preparing a solution of a liquid additive in a liquid base wherein the liquid additive tends to gel when mixed with the liquid base at temperatures less than a gelling temperature $T_G$ includes the steps of providing a stream of the liquid base at a temperature $T_C$ which is greater than ambient temperature and less than the gelling temperature $T_G$; feeding the stream to a mixer having a mixer inlet so as to impart energy to the stream; and adding the liquid additive to the stream downstream of the inlet, whereby the liquid additive mixes with the liquid base and the energy inhibits gelling of the liquid additive.

12 Claims, 3 Drawing Sheets

PROCESS FOR PREPARING SOLUTIONS WITH ADDITIVES AND SURFACTANTS

BACKGROUND OF THE INVENTION

The invention relates to a process for preparing solutions with additives and surfactants and, more particularly, to a process effective in preparing such solutions where one or more additives have a tendency to gel.

Numerous industrial processes require additives for various purposes. These additives may be provided commercially at high concentrations, and are then typically diluted with a liquid base such as water to the desired concentration for use.

However, simple dilution of such additives are not always effective since some additives have a tendency to gel when directly mixed with water. Such additives have a gelling temperature profile, and gelling is particularly problematic when the mixture is carried out below the gelling temperature.

Surfactants are one type of additive, for example as can be used to manufacture emulsions and the like, which has a tendency to gel when mixed with water below the gelling temperature of the surfactant. This makes difficult the use of such additives in industrial processes and poses a problem for which a solution is needed.

It is therefore the primary object of the present invention to provide a process for effectively mixing a liquid additive with a liquid base without gelling.

It is a further object of the present invention to provide such a process which utilizes inexpensive and reliable equipment, and which can be readily installed in various industrial locations.

Other objects and advantages of the present invention will appear hereinbelow.

SUMMARY OF THE INVENTION

In accordance with the present invention, the foregoing objects and advantages have been readily attained.

According to the invention, a process is provided for preparing a solution of a liquid additive in a liquid base wherein the liquid additive tends to gel when mixed with the liquid base at temperatures less than a gelling temperature $T_G$, which process com rises the steps of providing a stream of said liquid base at a temperature $T_C$ which is greater than ambient temperature and less than said gelling temperature $T_G$; feeding said stream to a mixer having a mixer inlet so as to impart energy to said stream; and adding said liquid additive to said stream downstream of said inlet, whereby said liquid additive mixes with said liquid base and said energy inhibits gelling of said liquid additive.

This process is particularly effective for preparing solutions of surfactants in water, wherein the surfactant has a tendency to gel at typical ambient temperatures. One such surfactant is ethoxylated nonylphenol, among others.

BRIEF DESCRIPTION OF THE DRAWINGS

A detailed description of preferred embodiments of the present invention follows, with reference to the attached drawings, wherein.

DETAILED DESCRIPTION

The invention relates to a process for preparing solutions of additives and surfactants wherein heating and a static mixer are used to avoid gel formation of the additives.

As set forth above, numerous additives are provided at high concentration and, when diluted or added to water or other liquid bases, such additives have a tendency to form gels which interfere with effective mixing.

Figure 1:
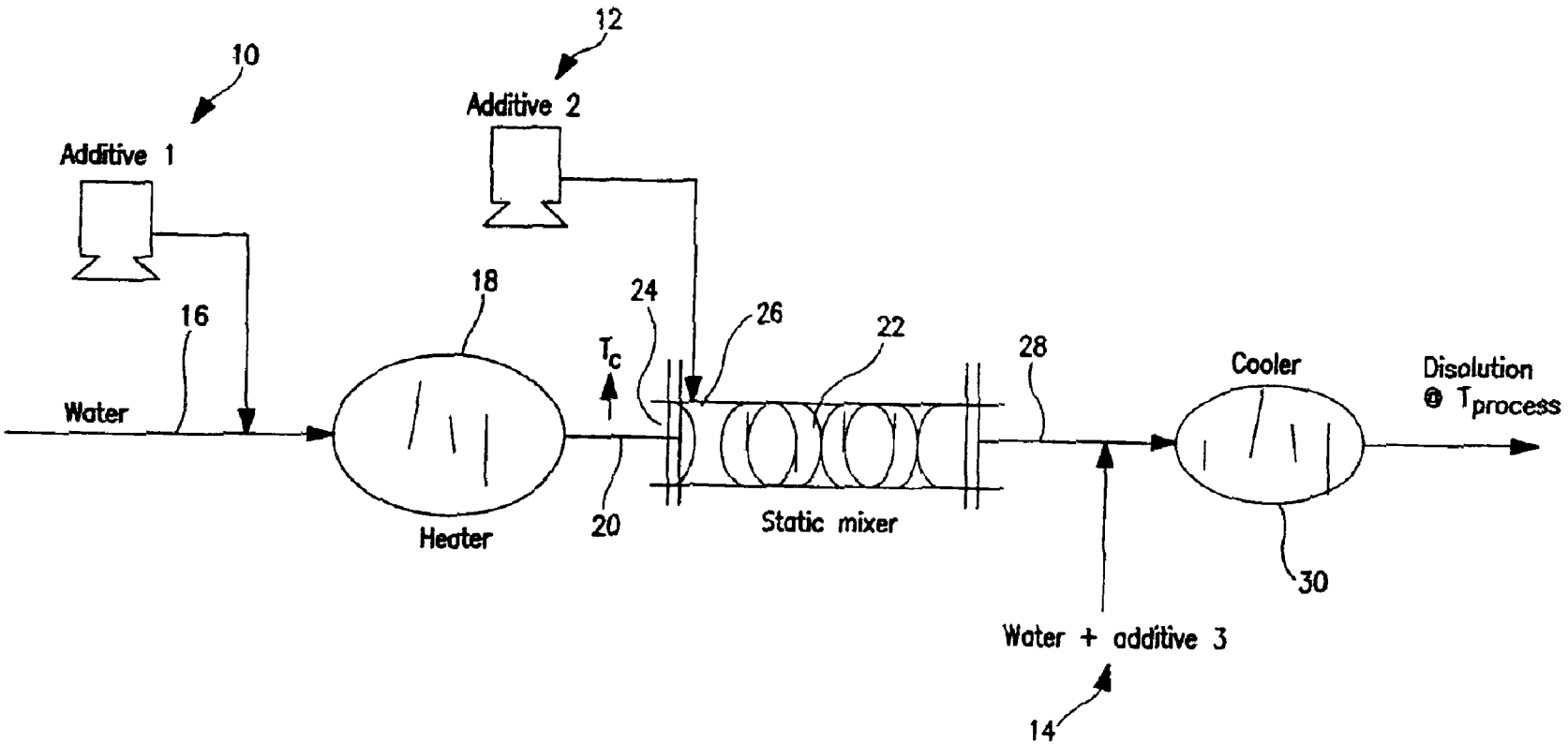
FIG. 1 schematically illustrates a process in accordance with the present invention.

FIG. 1 schematically illustrates a process wherein several additives 10, 12, 14 are to be added to a stream 16 of water. In accordance with this embodiment of the present invention, additives 10 and 14 are water soluble, and do not gel, and can therefore be added at any convenient point.

Additive 12, however, is an additive which tends to gel if mixed with water at ambient temperature. Stream 16 is therefore fed to a heater 18 to increase the temperature of stream 16 from ambient temperature to a temperature $T_C$ which is greater than ambient temperature, and which is preferably less than the maximum gelling temperature $T_G$ of additive 12. The heated stream 20 is then fed to a static mixer 22, through a static mixer inlet 24, to impart energy to the stream. Once at least some energy has been imparted to the stream, additive 12 is then added to static mixer, preferably at an additive inlet 26 which is schematically illustrated in FIG. 1.

The energy imparted to stream 20 within mixer 22 has advantageously been found to be sufficient to prevent gel formation of additive 12, despite the fact that the temperature of stream 20 has not been heated to a temperature above the gelling temperature $T_G$.

Stream 28 exiting static mixer 22 advantageously comprises a substantially homogeneous and gel-free mixture of water 16 and additive 12, along with any other additives 10 and the like which may have been provided as desired.

As set forth above, additives 10 and 14 are water soluble, and can be added at any point. Thus, in the embodiment illustrated in FIG. 1, additive 10 is added to stream 16 upstream of heater 18 and static mixer 22, while additive 14 is added downstream of mixer 22.

Still referring to FIG. 1, stream 28 can itself be fed, at temperature $T_C$, to further processing steps such as an emulsion forming step or the like, particularly when such process is effective at temperature $T_C$. This is advantageous since the heat used to form the solution can be used again in such emulsion preparation, thereby enhancing process efficiency.

For other processes, wherein lower temperatures are required, stream 28 can be fed to a cooler 30 as schematically illustrated so as to reduce the temperature to a temperature $T_P$ which is more suitable to the desired process.

Figure 2:
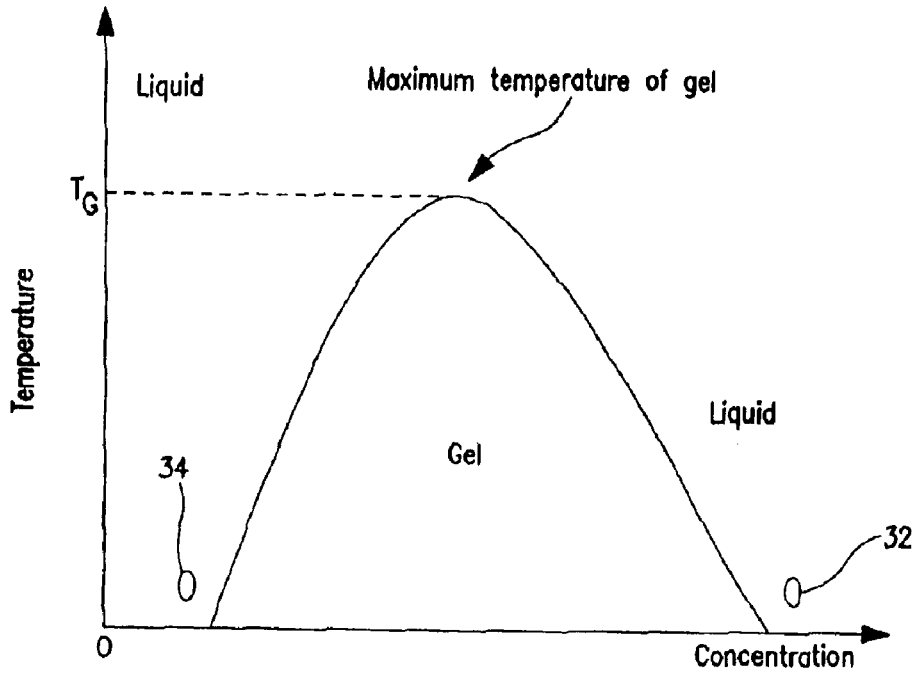
FIG. 2 illustrates the gel temperature profile for a typical surfactant material at different concentrations in water.
Figure 3:
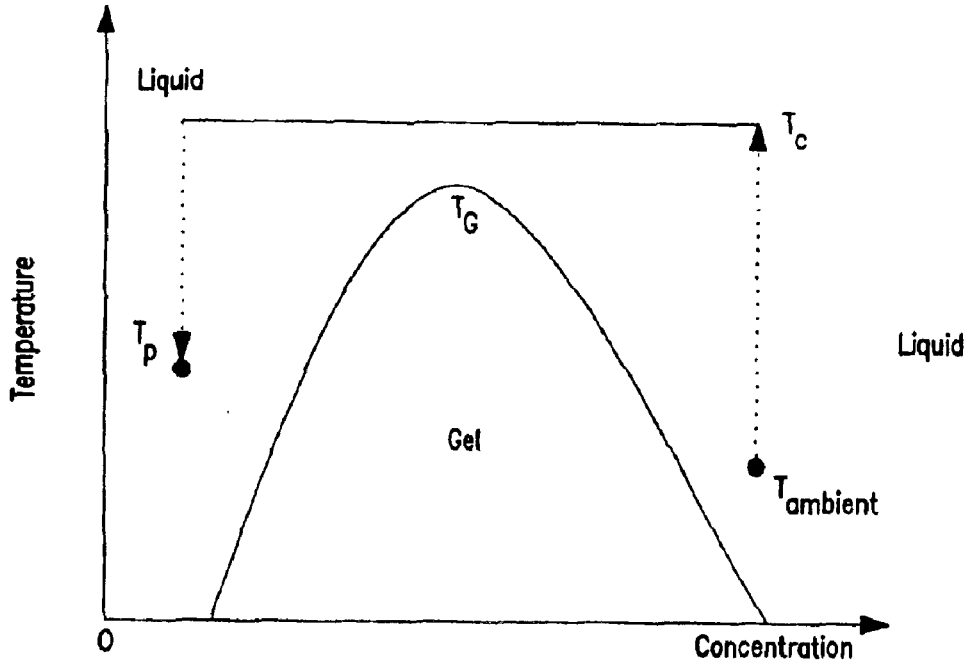
FIG. 3 illustrates a heat-only process that can be used to avoid gelling.
Figure 4:
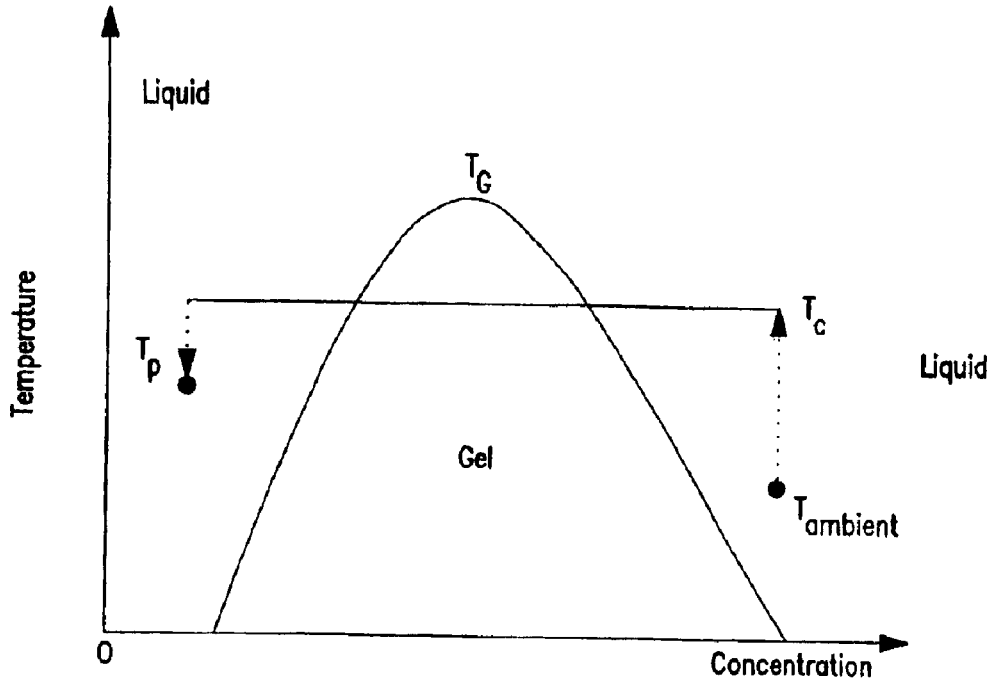
FIG. 4 illustrates a preferred embodiment of the present invention wherein some heat is applied, and mixing energy is used to avoid gel formation.

Referring to FIGS. 2–4, FIG. 2 shows a typical gel temperature profile for a liquid additive having gelling tendencies, and shows the gelling temperature $T_G$ at concentrations of the additive in water. As shown, at high concentrations the additive is liquid at substantially any temperature. As should also be clear, however, if such material is merely added to water, so as to reduce concentration at a low temperature, the additive will certainly gel and cause various problems.

One class of additives which has a gelling profile as illustrated in FIG. 2 are surfactants for use in making oil/water emulsions. For example, ethoxylated nonylphenol (NPE) has a profile as illustrated. NPE is typically provided commercially having a concentration in water of at least about 80% weight and typically about 90% weight or higher, which generally corresponds to point 32 shown in FIG. 2. It is typical to use such surfactant at a concentration of less than about 1% weight, and preferably about 0.2% weight, which corresponds to point 34 shown on FIG. 2. In accordance with the present invention, the process provided allows for dilution from point 32 to point 34 without the need to heat in excess of temperature $T_G$, and without the formation of gel. Other examples of similar additives that tend to gel include tridecyl ethoxylated alcohols, polymers that are soluble in water, and the like.

FIG. 3 illustrates the heating and cooling that would be necessary to go from ambient temperature to a processing temperature while heating to a temperature above $T_G$. While this would avoid formation of gel, it should readily be appreciated that the heating and cooling costs would be substantial.

Turning now to FIG. 4, the preferred process of the present invention is shown wherein the additive is diluted with water at a temperature that is heated to a temperature $T_C$ that is greater than ambient temperature, but less than the highest temperature for gel existence $T_G$. This moves the additive sufficiently high on the gel formation profile that energy imparted from the static mixer can successfully prevent formation of gel and allow effective mixture with the liquid base or water as desired.

It should readily be appreciated that the heating and cooling costs in the process of the present invention are substantially reduced as compared to that in FIG. 3. Further, a static mixer which is used to provide the energy desired is likewise efficiently operated, reliable and inexpensive.

Figure 5:
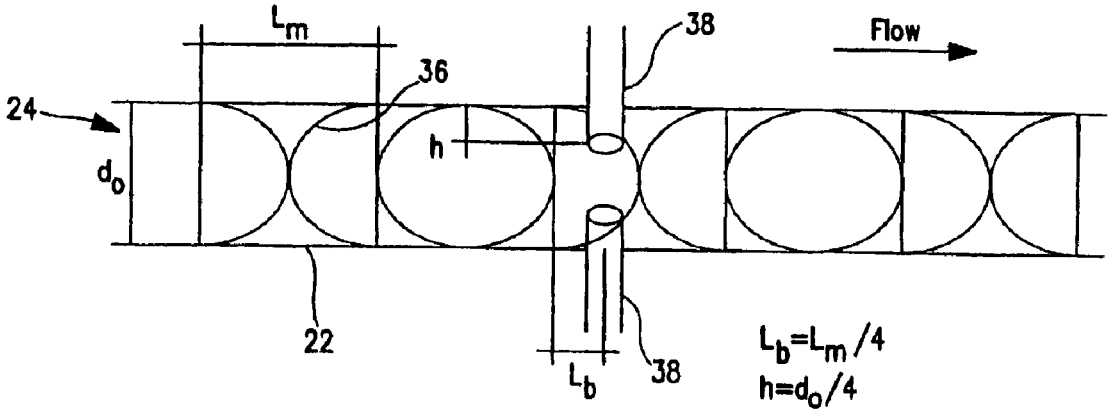
FIG. 5 schematically illustrates a preferred mixture in accordance with the present invention, along with preferred placement of an additive injector.

Turning now to FIG. 5, a preferred placement of additive inlet is illustrated. FIG. 5 schematically shows a static mixer wherein mixer 22 has a series of swirling flow imparting element 36 each having a length $L_m$ corresponding to a 90° rotation along mixer 22. Mixer 22 and elements 36 also have a diameter $d_o$. In accordance with the present invention, a surfactant or additive inlet 38, or preferably a plurality of inlets 38, are advantageously positioned downstream at the beginning of the third swirling flow imparting member 36 by a distance $L_b$ which is preferably approximately equal to $L_m/4$. Furthermore, inlet or inlets 38 advantageously extend inwardly into mixer 22 by a distance h which is preferably equal to about $d_o/4$. This advantageously injects the additive into the stream at a point where sufficient swirling energy has been imparted that gel formation can be avoided at temperatures less than the gel formation temperature. This advantageously provides for the excellent results obtained in accordance with the present invention.

It should readily be appreciated that the process provided can be carried out in a continuous manner, and provides for manufacture of downstream products such as viscous hydrocarbon in water emulsions with a high degree of quality since surfactant concentration is homogeneously distributed through the water phase. Furthermore, it should readily be appreciated that this process provides such excellent results with a minimum amount of energy used for heating and/or cooling, and utilizing a mixer which requires a minimum amount of maintenance.

The following examples demonstrates the excellent results obtained in accordance with the present invention.

EXAMPLE 1

In this example, a Kenics™ mixer having ¾inch×12 elements was used to mix an ethoxylated nonylphenol with water at a temperature of 35° C. This water had been heated to 35° C. from ambient temperature. Mixing was carried out at various water flow rates and additive flow rates, with mixing energy imparted by the static mixer being determined based upon the materials fed to the mixer, the process temperature and specifics of the mixer. Table 1 below sets forth the amounts of dissolution obtained in each case.

TABLE 1

| Water Flow (l/s) | Additive Flow (ml/min.) | Mixing Energy (W/Kg) | Dissolution Degree (grs dissolved/total grs) |
|---|---|---|---|
| 0.42 | 303 | 199 | 0.99 |
| 0.33 | 240 | 104 | 0.98 |
| 0.24 | 180 | 40 | 0.94 |
| 0.12 | 84 | 4 | 0.78 |

As shown, excellent dissolution was obtained at mixing energy of 40 W/Kg and above for the flows shown. At a mixing energy of only 4 W/Kg only 78% dissolution was obtained. Thus, the mixing energy provided by the static mixer in accordance with the present invention clearly helps to avoid gel formation and enhances complete dissolution of the additive.

EXAMPLE 2

In this example, a Sulzer™ mixer SMX, with 1.5 inch×8 elements, was used to mix water at 35° C. with the same surfactant as it Example 1. Table 2 below sets forth the water flow, additive flow, mixing energy and dissolution degree obtained.

TABLE 2

| Water Flow (l/s) | Additive Flow (ml/min.) | Mixing Energy (W/Kg) | Dissolution Degree (grs dissolved/total grs) |
|---|---|---|---|
| 1.42 | 1052 | 341 | 0.92 |
| 1.24 | 894 | 231 | 0.94 |
| 0.92 | 666 | 99 | 0.69 |
| 0.57 | 408 | 85 | 0.63 |

As shown, dissolution with this mixer was not as effective as with the mixer of Example 2. Thus, the geometric configuration of the mixing elements of the mixer, which are different in both commercial mixers, is important.

EXAMPLE 3

In this example, a stream of heated water was mixed with surfactant in three different locations along the mixer in order to demonstrate the advantageous position of injectors for the additive.

In the first instance, the additive was injected at the entrance to the mixer, along with the water. In the second evaluation, the additive was injected through a single injector at a point as selected according to the illustration of FIG. 5. Finally, in a third evaluation, additive was injected through two injectors positioned at a point as illustrated in FIG. 5.

With the additive introduced at the entrance to the mixer, only 72% dissolution was obtained. With additive introduced through a single injector downstream of the inlet, 80% dissolution was obtained. With the additive injected through two Injectors downstream of the inlet as illustrated in FIG. 5, 94% dissolution was obtained. This, positioning of the injector or inlet for the additive in accordance with the present invention provides for enhanced dissolution as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for preparing an emulsion using a solution of a liquid additive in a liquid base wherein the liquid additive tends to gel when mixed with the liquid base at temperatures less than a maximum gelling temperature $T_G$ of said liquid additive, comprising the steps of:

providing a stream of said liquid base at a temperature $T_C$ which is greater than ambient temperature and less than said gelling temperature $T_G$;

feeding said stream to a static mixer having a mixer inlet so as to impart energy to said stream;

adding said liquid additive to said static mixer downstream of said inlet so as to form said solution, whereby said liquid additive mixes with said liquid base and said energy is at an effective amount to inhibit gelling of said liquid additive at $T_c$; and mixing said solution with an oil phase so as to form said emulsion.

2. The process of claim 1, wherein said liquid base is provided at ambient temperature, and further comprising feeding said stream to a heater to heat said stream to said temperature $T_C$.

3. The process of claim 2, further comprising the step of adding liquid base soluble additives to said stream.

4. The process of claim 1, wherein said liquid additive is provided at a concentration of at least about 80% weight and is diluted by mixing with said liquid base to a concentration of liquid additive of less than about 1% weight.

5. The process of claim 1, wherein said mixer is a static mixer adapted to impart a swirling flow to said stream, and having said mixer inlet for said stream and a liquid additive inlet downstream of said mixer inlet.

6. The process of claim 5, wherein said static mixer has swirling flow imparting elements having a length Lm and diameter $d_o$, and wherein said liquid additive inlet is spaced along a swirling flow imparting member by a distance $L_b=L_m/4$.

7. The process of claim 6, wherein said liquid additive inlet extends inwardly past said swirling flow imparting elements by a distance $h=d_o/4$.

8. The process of claim 1, wherein said liquid base is water and said liquid additive is a surfactant.

9. The process of claim 8, wherein said surfactant comprises ethoxylated nonylphenol.

10. The process of claim 1, wherein said mixer provides said solution comprising a substantially homogeneous liquid mixture of said liquid base and said liquid additive.

11. The process of claim 10, further comprising feeding said liquid mixture to said mixing step at said temperature $T_C$.

12. The process of claim 1, wherein the oil phase is a viscous hydrocarbon, wherein the liquid base is water, and wherein the emulsion is an emulsion of the viscous hydrocarbon in water.

* * * * *